US009301590B2

(12) United States Patent
Thompson

(10) Patent No.: US 9,301,590 B2
(45) Date of Patent: Apr. 5, 2016

(54) RETRACTABLE COSMETIC PENCIL

(71) Applicant: International Cosmetic Suppliers Ltd, Taipei (TW)

(72) Inventor: David Julian Cave Thompson, Taipei (TW)

(73) Assignee: INTERNATIONAL COSMETIC SUPPLIERS LTD, Taipei (TW)

( * ) Notice: Subject to any disclaimer, the term of this patent is extended or adjusted under 35 U.S.C. 154(b) by 0 days.

(21) Appl. No.: 14/509,758

(22) Filed: Oct. 8, 2014

(65) Prior Publication Data

US 2015/0098746 A1 Apr. 9, 2015

Related U.S. Application Data

(60) Provisional application No. 61/888,494, filed on Oct. 8, 2013.

(51) Int. Cl.
*A45D 40/20* (2006.01)
*A45D 40/16* (2006.01)

(52) U.S. Cl.
CPC ..... *A45D 40/205* (2013.01); *A45D 40/16* (2013.01); *A45D 2040/208* (2013.01)

(58) Field of Classification Search
CPC combination set(s) only.
See application file for complete search history.

(56) References Cited

U.S. PATENT DOCUMENTS 1,442,662 A * 1/1923 Guinn ..... A46B 11/0027 132/290
1,671,122 A * 5/1928 Ormond ..... 222/254
2,559,906 A 7/1951 Tursky
4,334,546 A 6/1982 Floyd et al.
4,545,696 A * 10/1985 Carluccio ..... 401/175
4,828,419 A 5/1989 Porter et al.
4,890,944 A * 1/1990 Cousins et al. ..... 401/98
4,932,803 A * 6/1990 Goldberger et al. ..... 401/75
5,221,153 A 6/1993 Spatz
5,294,205 A 3/1994 Moeck et al.
5,780,018 A 7/1998 Collins et al.
5,957,607 A 9/1999 Tsai
5,997,206 A 12/1999 Lin (Continued)

FOREIGN PATENT DOCUMENTS

EP 1452109 9/2004

OTHER PUBLICATIONS

Wenzhou Zhonghuan Packing Machinery Co., Ltd; "Automatic Hot Filling & Capping Machine (TZ-25L-12A)—China Mascara Filling machine"; http://cnfillingmachine.en.made-in-china.com/product/WBdxyLEAsnhQ/China-Automatic; published 2003 and retrieved on Sep. 13, 2013.

(Continued)

*Primary Examiner* — David Walczak
(74) *Attorney, Agent, or Firm* — Novak Druce Connolly Bove + Quigg LLP

(57) ABSTRACT

A retractable cosmetic pencil including a barrel, godet, lower threaded portion and an end cap is disclosed. The godet can be configured to move longitudinally within the barrel. The lower threaded portion can be configured to be coupled to the godet. The end cap can be configured to be coupled to the lower threaded portion. An injection receiving opening can formed in the closed end of the end cap, wherein the injection receiving opening is configured to receive an injection nozzle such that the retractable cosmetic pencil can be backfilled when the godet is in a retracted position relative to the lower threaded portion.

12 Claims, 11 Drawing Sheets

(56) References Cited

U.S. PATENT DOCUMENTS

| | | | |
|---|---|---|---|
| 6,086,277 | A | 7/2000 | Gutberlet |
| 6,220,255 | B1 | 4/2001 | Hempel |
| 6,409,402 | B2 | 6/2002 | Tani et al. |
| 7,503,717 | B2 | 3/2009 | Gutberlet |
| 7,651,291 | B2 | 1/2010 | Py et al. |
| 8,328,445 | B2 | 12/2012 | Martins et al. |
| 8,328,447 | B2 | 12/2012 | Tani |
| 2009/0214283 | A1 | 8/2009 | Thiebaut |
| 2011/0142891 | A1 | 6/2011 | Pschirer et al. |

OTHER PUBLICATIONS

Chubby & Slim Pencils; http:// www.ics-world.com/?p=products &pid=17.pdf; Aug. 29, 2003.

* cited by examiner

RETRACTABLE COSMETIC PENCIL

CROSS-REFERENCE TO RELATED APPLICATION

The application claims priority to U.S. Provisional Application No. 61/888,494, filed Oct. 10, 2013, the contents of which are entirely incorporated by reference herein.

FIELD OF DISCLOSURE

The present disclosure relates to a retractable cosmetic pencil.

BRIEF DESCRIPTION OF THE DRAWINGS

Embodiments of the present application will now be described, by way of example only, with reference to the attached Figures, wherein.

DETAILED DESCRIPTION

Figure 1:
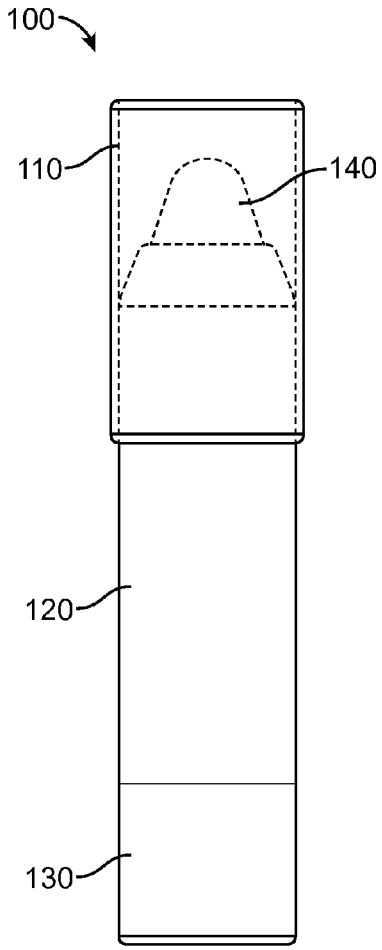
FIG. 1 illustrates an elevational view of an exemplary retractable pencil according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein.

The present disclosure concerns a retractable cosmetic pencil that can be backfilled in retracted configuration. The backfilling in the retracted configuration can save time relative to a normal filling process in which the cosmetic is filled from the top. Additionally, it can save labor relative to prefilling a godet and assembling the retractable pencil. The present disclosure implements a backfilling aperture formed in an end cap of the retractable mechanical pencil. The backfilling aperture allows for the injection of the cosmetic when the godet is in a retracted position relative to the body of the retractable cosmetic pencil. In at least one embodiment, the godet is designed such that it is substantially the same diameter of the inner diameter of the body of the retractable cosmetic pencil. In at least one embodiment, the godet has a side wall portion that slides relative to the barrel.

FIG. 1 illustrates an elevational view of an exemplary retractable cosmetic pencil 100 according to the present disclosure. As illustrated, the retractable cosmetic pencil 100 can include a cosmetic cap 110, a barrel 120, and an end cap 130. In at least one configuration, the end cap 130 can be configured to be rotated relative to the barrel 120 so that the cosmetic 140 can move longitudinally relative to the barrel 120 in response to rotation of the end cap 130. The rotation of the end cap 130 to move the cosmetic 140 is an exemplary illustration and other mechanisms for advancement of the cosmetic 140 are considered within the scope of this disclosure.

Figure 2A:
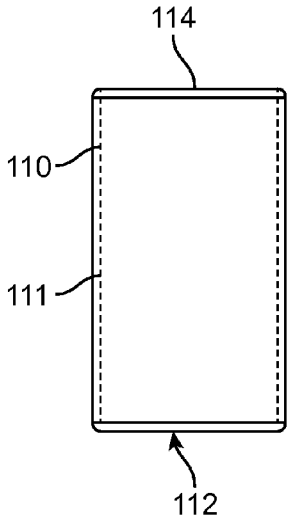
FIG. 2A illustrates an elevational view of the cosmetic cap of the exemplary retractable pencil of FIG. 1.
Figure 2B:
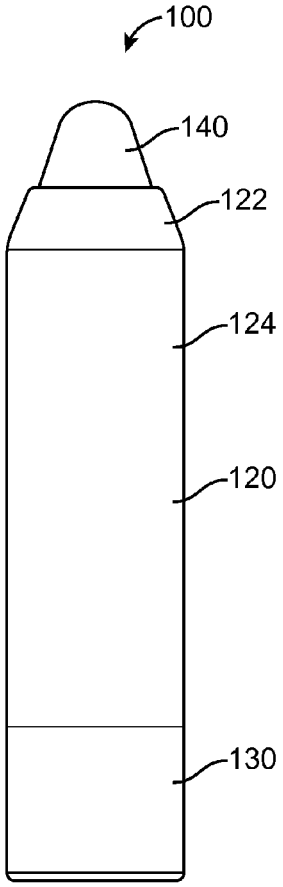
FIG. 2B illustrates an elevational view of the exemplary retractable pencil of FIG. 1 wherein a cap has been removed so as to expose the cosmetic.

FIGS. 2A and 2B illustrate an elevational view of the exemplary retractable cosmetic pencil 100 of FIG. 1 wherein the cosmetic cap 110 has been removed so as to expose the cosmetic 140. The cosmetic cap 110 can have a longitudinal wall 111, a hole 112 formed in the first end of the cosmetic cap 110, and a substantially or fully closed end 114. In one embodiment, the substantially closed end 114 can have a through hole formed therein to allow for the cap to be more easily installed and removed. In other embodiments, the fully closed end 114 can be entirely sealed. The cosmetic cap 110 as illustrated is substantially cylindrical in shape. In other embodiments, the cosmetic cap 110 can have other shapes such as conical, curvilinear, spherical (for example a hemispherical shape) or other non-cylindrical shape. The hole 112 allows for part of the cosmetic 140 to enter the cosmetic cap 110. In other embodiments, the cosmetic cap 110 can be omitted and a seal to initially protect or cover the cosmetic 140 can be provided. The seal can be a disposable cover or other device that keeps the cosmetic clean.

As illustrated the cosmetic 140 is exposed when the cosmetic cap 110 is removed. When the cosmetic 140 is exposed it can be applied to the desired person or object. When the exposed cosmetic 140 is less than a desired amount, the present disclosure allows for additional cosmetic 140 to be exposed by rotating the end cap 130. In the illustrated embodiment, the initially exposed cosmetic 140 and top portion 122 of the barrel 120 can have a similar shape. In other embodiments, the top portion 122 can have other shapes which do not resemble the exposed cosmetic 140. As illustrated the exposed cosmetic is substantially conical.

Figure 3:
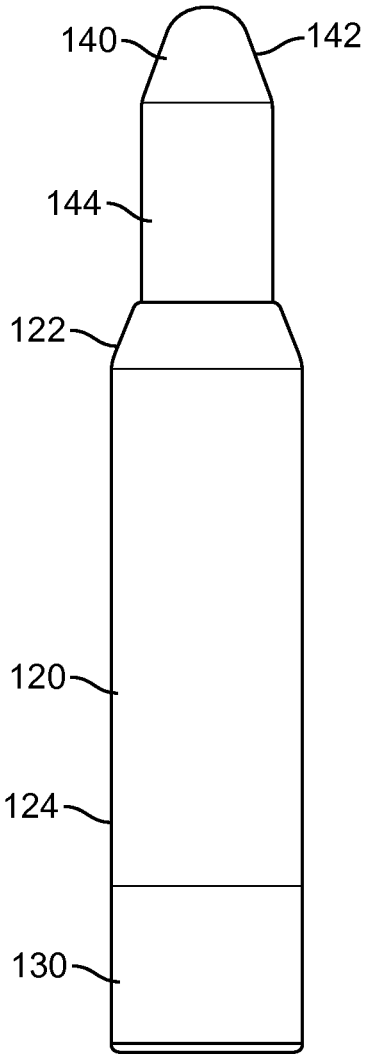
FIG. 3 illustrates an elevational view of the exemplary retractable pencil of FIG. 1 wherein the cosmetic has been extended to be in a fully extended state.

FIG. 3 illustrates an elevational view of the exemplary cosmetic retractable pencil 100 of FIG. 1 wherein the cosmetic 140 has been extended to be in a fully extended state. In the fully extended state the formed end 142 of the cosmetic 140 can have a different shape than the body 144 of the cosmetic 140. As illustrated the formed end 142 of the cosmetic has a substantially conical shape and the body of the cosmetic 144 has a substantially cylindrical shape. In other embodiments, the shape of the body 144 of the cosmetic 140 and the formed end 142 can have substantially the same shape. In at least one embodiment, the formed end 142 can have a shape based upon the type of cosmetic 140 that is present. For example, the formed end 142 can have a slanted shape when the cosmetic 140 is a lipstick. When the cosmetic 140 is an eyeliner, the formed end 142 can have a conical shape.

Figure 4:
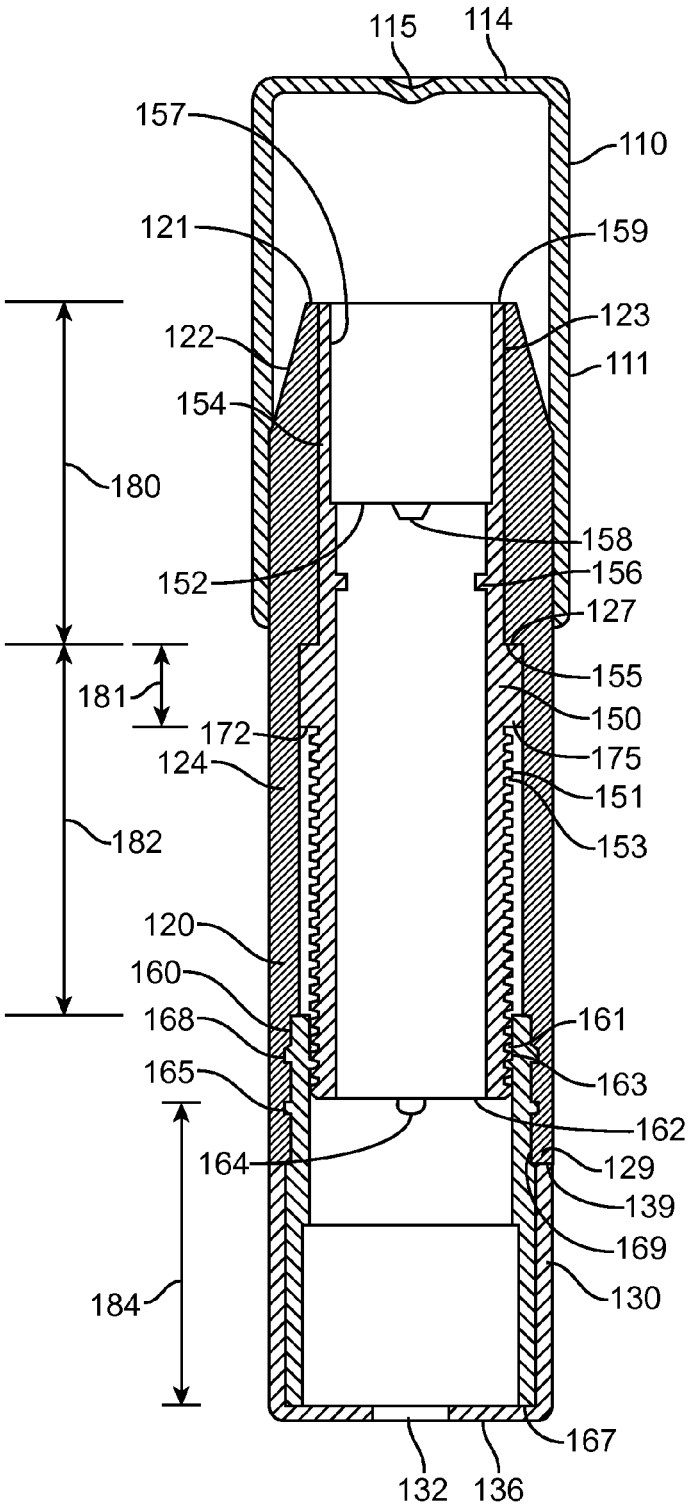
FIG. 4 illustrates cross-sectional view of an exemplary retractable pencil according to the present disclosure.

FIG. 4 illustrates cross-sectional view of an exemplary retractable cosmetic pencil 100 according to the present disclosure. As illustrated in the cross-section, the retractable cosmetic pencil 100 can include a cosmetic cap 110, a barrel 120, and an end cap 130. The cosmetic cap 110 includes an indention 115 in a closed end 114. The closed end 114 can be substantially closed or completely closed. The substantially closed end 114 can include one or more vents or other through openings that allow air to communicate between the inside of the cosmetic cap 110 and the exterior of the cosmetic cap 110. The cosmetic cap can include a longitudinal wall 111. The longitudinal wall 111 can be substantially straight. In other embodiments, the longitudinal wall 111 can be curvilinear. In at least one embodiment, the shape of the longitudinal wall 111 can be such that it matches the barrel 120 or the shape of the cosmetic 140 beneath the cosmetic cap 110.

In at least one embodiment, the barrel 120 of the retractable cosmetic pencil 100 can include a top portion 122 and a side portion 124. As illustrated, the top portion 122 and the side portion 124 can have different shapes. In at least one embodiment, the side portion 124 can be substantially cylindrical. In other embodiments, the side portion 124 can take other shapes as a curvilinear shape or the like. The barrel 120 has in inner side wall 123. The inner side wall 123 can be substantially smooth. In other embodiments, the inner side wall 123 can have another shape such that it allows for more secure movement of the godet 150 within the barrel 120. The barrel 120 can include a distal end 121. The distal end 121 is the end of the barrel 120 through which the cosmetic 140 passes and thereby is exposed for use.

Figure 12:
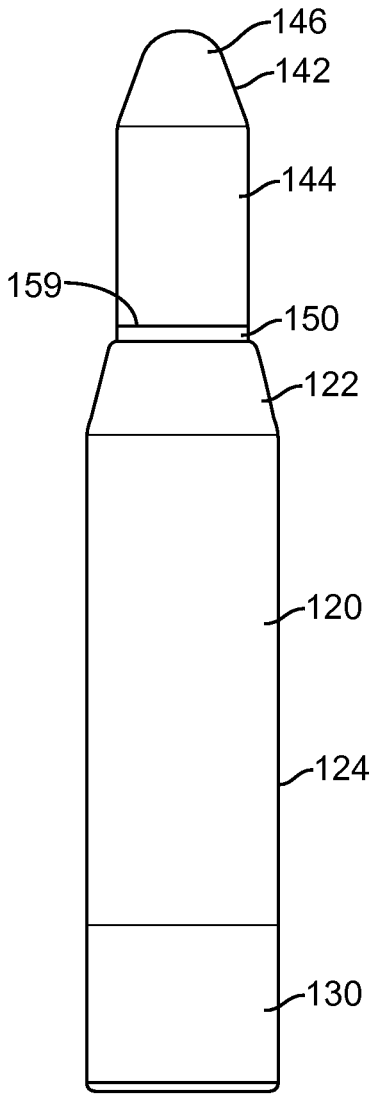
FIG. 12 illustrates an elevational view of another exemplary retractable pencil wherein the cosmetic has been extended to be in a fully extended state and a portion of the godet is exposed.

The godet 150 can be configured to move relative to the barrel 120. In the illustrated embodiment, the godet 150 moves in a linear and/or longitudinal direction relative to an axis of the barrel 120. As illustrated, the godet 150 can include a stop portion 175. The barrel 120 can have a stop forming portion 127 that the upper stop surface 155 of the godet 150 contacts when the godet 150 is in a fully extended state. In the fully extended state, the godet 150 can have a distal end 159 that is substantially flush with the distal end 121 of the barrel 120. In other embodiments, the distal end 159 of the godet 150 can be slightly recessed relative to the distal end 121 of the barrel 120. By having the distal end 159 flush or slightly recessed the user of the cosmetic retractable pencil 100 will not experience any contact with the godet 150. In other embodiments, it may be desirable to have a portion of the godet 150 extend beyond distal end 121 of the barrel 120. An example is illustrated in FIG. 12 below.

In the illustrated embodiment, the godet 150 can be threaded such that it has a ridge 151 and a valley 153. The ridges 151 and valleys 153 cooperate together to form the thread. In at least one embodiment, the dimensions of the ridges 151 and valleys 153 can be based upon the diameter of the godet 150. As illustrated, the threads of the godet 150 extend from a proximal end 162 of the godet to the lower stop surface. In some embodiments, the length of the threaded portion can be less than the threaded portion illustrated such that the threads do not extend all the way to proximal end 162 of the godet 150 or do not extend all of the way to the lower stop surface.

As illustrated, retractable cosmetic pencil 100 can include a lower threaded portion 160 can be configured to be coupled to the end cap 130. The lower threaded portion 160 can be configured to be press coupled to the end cap 130 such that a friction fit is achieved. In another embodiment, the lower threaded portion 160 can be secured to the end cap 130 using an adhesive or other binding material. In other embodiments, the end cap 130 and lower threaded portion 160 can be vibrationally welded together. In yet another embodiment, the end cap 130 can be co-molded. In yet another embodiment, the lower threaded portion 160 and end cap 130 can be molded out of single piece of material.

As illustrated, the lower threaded portion 160 has an end cap abutting surface 167. The end cap abutting surface can abut the substantially or fully closed end 136 of the end cap 130. In other embodiments, the end cap abutting surface 167 can be spaced apart from the closed end 136 such that a gap is formed therebetween. The end cap 130 has an injection receiving opening 132 formed in the closed end 136. Additionally, in at least one embodiment, the lower threaded portion 160 can extend beyond the barrel abutment portion 139 of the end cap 130.

The portion of the lower threaded portion 160 that extends beyond the barrel abutment portion 139 of the end cap 130 can be configured to be coupled to the barrel 120. As illustrated, the lower threaded portion 160 can include a first barrel engaging portion 165 and a second barrel engaging portion 168. The barrel engaging portion 165 and second barrel engaging portion 168 can be such that the lower threaded portion 160 can rotate relative to the barrel 120 thereby allowing the godet 150 to move in relation to the barrel 120.

As illustrated, a godet end distance 180 is formed between the distal end 159 of the godet 150 and the upper surface 155 of the stop 175 of the godet 150. Additionally the stop 175 can have a height 181. Furthermore, a distance 182 is formed between the upper surface 155 of the stop 175 of the godet 150 and the distal end of the lower threaded portion 160. Additionally, a distance 184 is formed between the proximal end 162 of the godet 150 and the inner surface of the closed end 136 of the end cap 130. In at least one embodiment, the distance 184 is the shortest of the three distances 180, 182, 184 and the distance 182 is longest of the three distances with distance 180 between them. When the first distance 180 is longer than the third distance 184, the godet 150 can move within the barrel 120 while a portion of the godet 150 remains within the upper inner side wall 123 of the barrel 120, thereby preventing the cosmetic from galling the mechanism and preventing efficient operation of the retractable cosmetic pencil 100.

As illustrated the threads of the godet 150 engage with the threads of the lower threaded portion 160. The lower threaded portion includes a ridge 161 and a valley 163 that engage with the ridge 151 and valley 153 of the godet 150.

When the end cap 130 rotates relative to the barrel 120 the barrel abutment portion 139 of the end cap rotates relative to the proximal end 129 of the barrel 120. In at least one embodiment, the relative rotation can be a sliding rotation such that the two surfaces are slidingly engaged. In other embodiments, a gap can be formed between the proximal end 129 and the barrel abutment portion 139. In other embodiments, a groove and ridge can be implemented to prevent the end cap 130 from twisting off its relative axis in relation to the barrel 120. Additionally, the lower threaded portion 160 has a barrel abutment portion 169 which abuts the proximal end 129 of the barrel 120. The barrel abutment portion 169 can rotate substantially in the same fashion as the barrel abutment portion 139 of the end cap 130.

Figure 11:
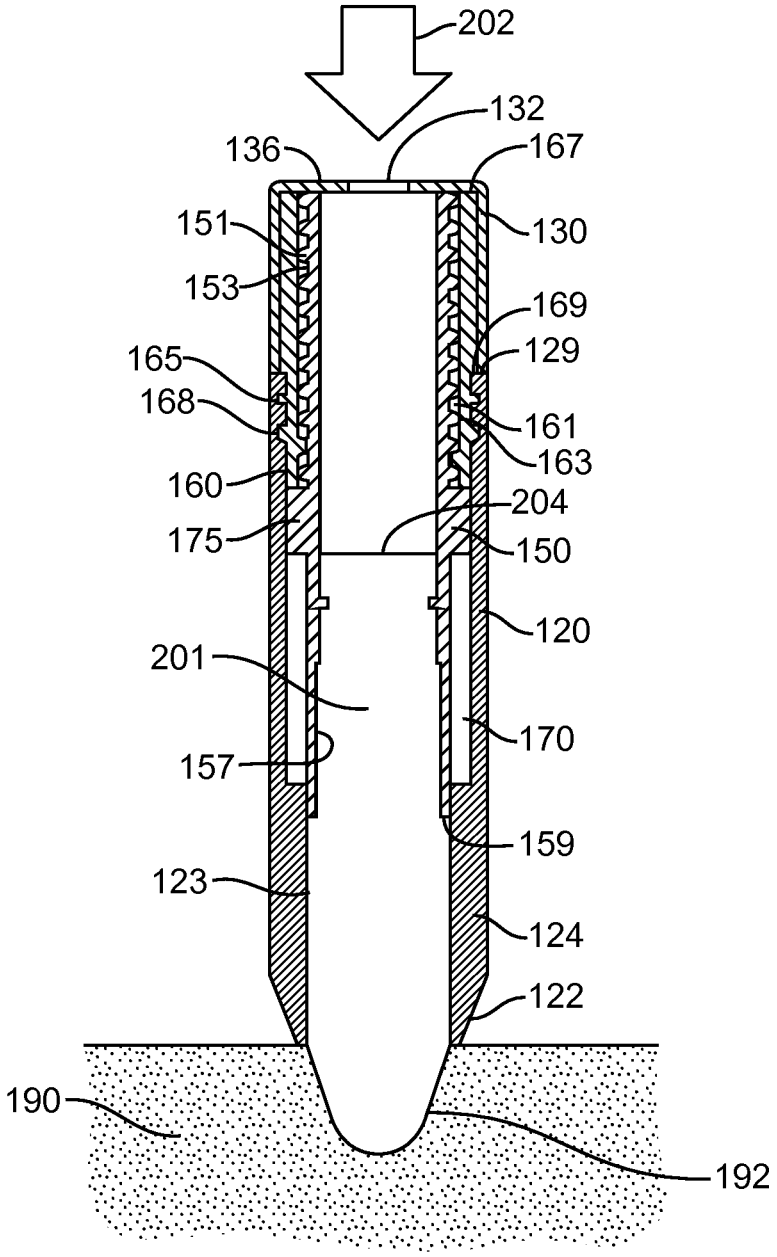
FIG. 11 illustrates a cross-sectional view of an exemplary retractable pencil above a mold in a filling process, according to the present disclosure.

Furthermore, in the illustrated embodiment cosmetic retention member 158 is present. The cosmetic retention member 158 can be formed to allow for the godet 150 to retain the cosmetic more easily. In at least one embodiment, the distance between the inner side wall 157 of the godet 150 is less than the distance between the inner side wall 123 of the barrel 120. In this configuration, the inner side wall 123 can form part of the mold when the cosmetic is injected as illustrated in FIG. 11 below. Further, the godet 150 can include one or more inward protrusions 156. The inward protrusion 156 can be molded with the side wall 154 of the godet 150. The inward protrusion 156 can provide resistance to hold the cosmetic in place. In other embodiments, a shelf can be installed in addition to the inward protrusion 156. In still other embodiments, other devices can be implemented to hold the cosmetic in place. The illustrated embodiment further includes a diameter change region 152 of the inner wall 157 of the godet 150. This diameter change region is provided to provide further resistance to the movement of the cosmetic. In other embodiments not illustrated, the various mechanisms to prevent the motion of the cosmetic in the godet 150.

In order to further illustrate the features described above in relation to FIG. 4, FIGS. 5-7 are provided. The numbering of the items are the same as with respect to FIG. 4 for simplicity. Additionally, the various features as described above can be implemented so that only necessary components for the desired design can be included and other components and features can be omitted as necessary.

Figure 5:
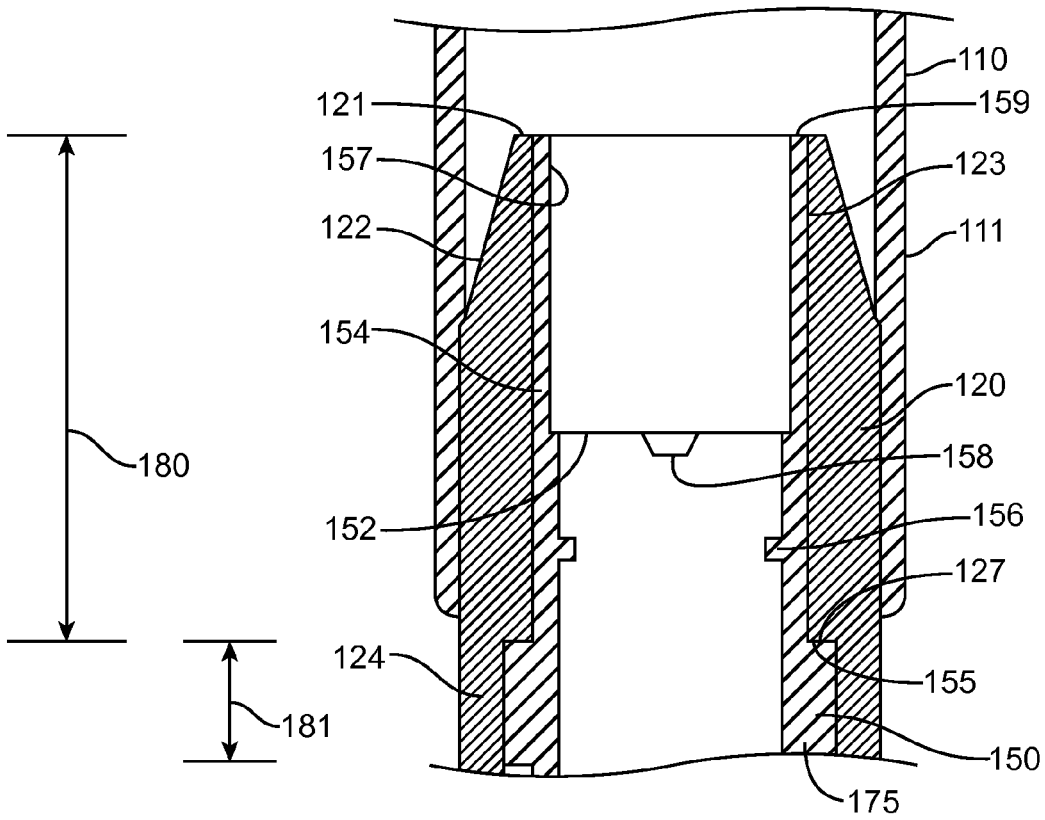
FIG. 5 illustrates a detailed cross-sectional view of joining of a barrel and a cap of the exemplary retractable pencil of FIG. 4.

FIG. 5 illustrates a detailed cross-sectional view of joining of a barrel 120 and a cosmetic cap 110 of the exemplary retractable cosmetic pencil 100 of FIG. 4. In the illustration, the godet 150 is in an extended position such that the distal end 159 of the godet 150 is flush with the distal end 121 of the barrel 120.

Figure 6:
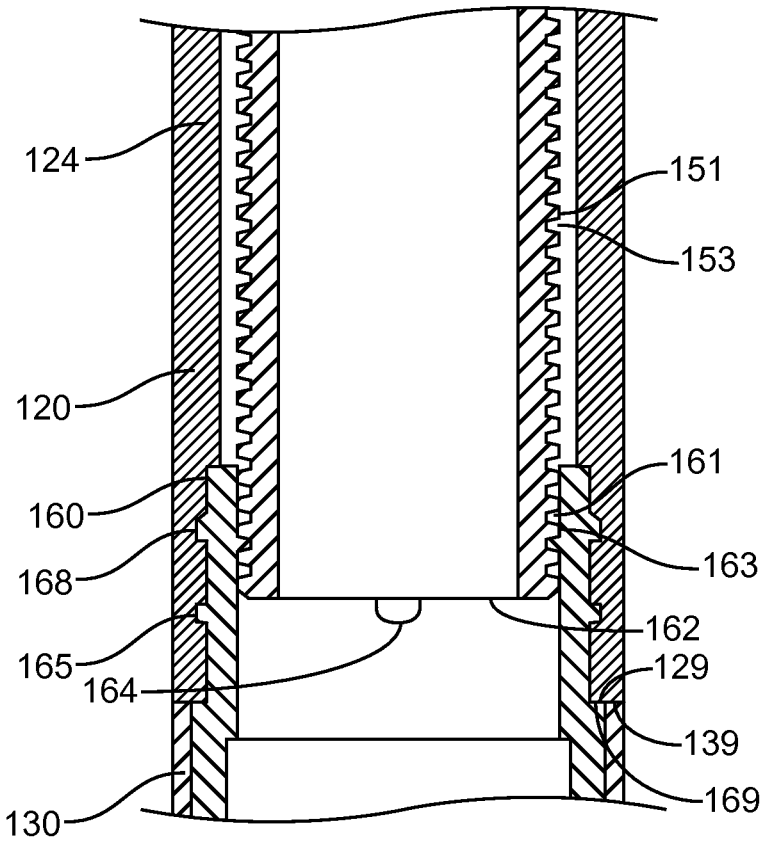
FIG. 6 illustrates a detailed cross-sectional view of joining of a godet and a lower threaded portion of the exemplary retractable pencil of FIG. 4.

FIG. 6 illustrates a detailed cross-sectional view of joining of a godet 150 and a lower threaded portion 160 of the exemplary retractable pencil 100 of FIG. 4. This view shows the godet 150 in a fully extended state relative to the lower threaded portion 160. The lower threaded portion 160 can have cutouts 164 formed in the side walls that extend a predetermined distance so that the sidewalls can flex slightly during assembly. The flexing of the sidewalls can provide for quicker and easier assembly and further prevent breakage when forces are applied in a non-axial direction when using the retractable cosmetic pencil 100. In one example, two cutouts 164 can be implemented. In other embodiments more than two cutouts 164 can be implemented. In one example, the cutouts 164 can be spaced apart by approximately 180 degrees. By approximate, a degree of inexactness is considered within the scope of this disclosure for example about 5 to 10 degrees of variation is considered within the scope of this disclosure.

Figure 7:
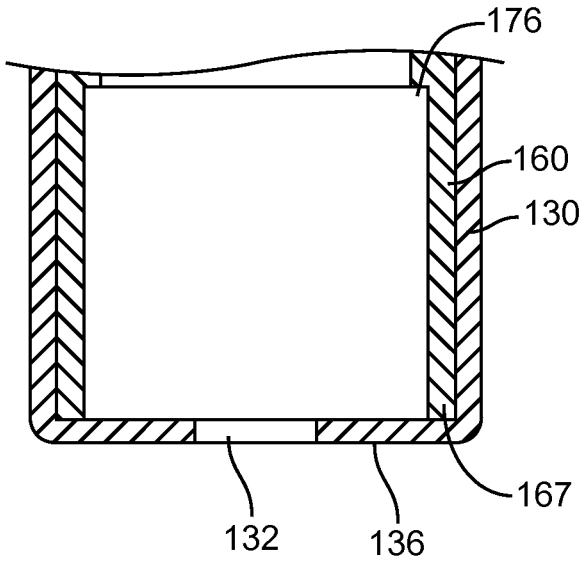
FIG. 7 illustrates a detailed cross-sectional view of end cap of the exemplary retractable pencil of FIG. 4.

FIG. 7 illustrates a detailed cross-sectional view of end cap of the exemplary retractable pencil of FIG. 4. As illustrated the injection receiving opening 132 is formed in the end cap 130. The injection receiving opening 132 can be sized based upon the back fill nozzle that is to be inserted therethrough. The back fill nozzle size can be based on the cosmetic that is to be injected or the temperature of the cosmetic or some combination thereof. In at least one embodiment, the injection receiving opening is sized such that it can also be easily covered with label and/or a plug. As described above, the lower threaded portion 160 can be coupled to the end cap 130 through a variety of different devices, mechanism, and methods. For instance, the lower threaded portion 160 can be friction fit within the end cap 130. In yet other embodiments, an adhesive can be implemented to hold the lower threaded portion 160 within the end cap 130.

Figure 8:
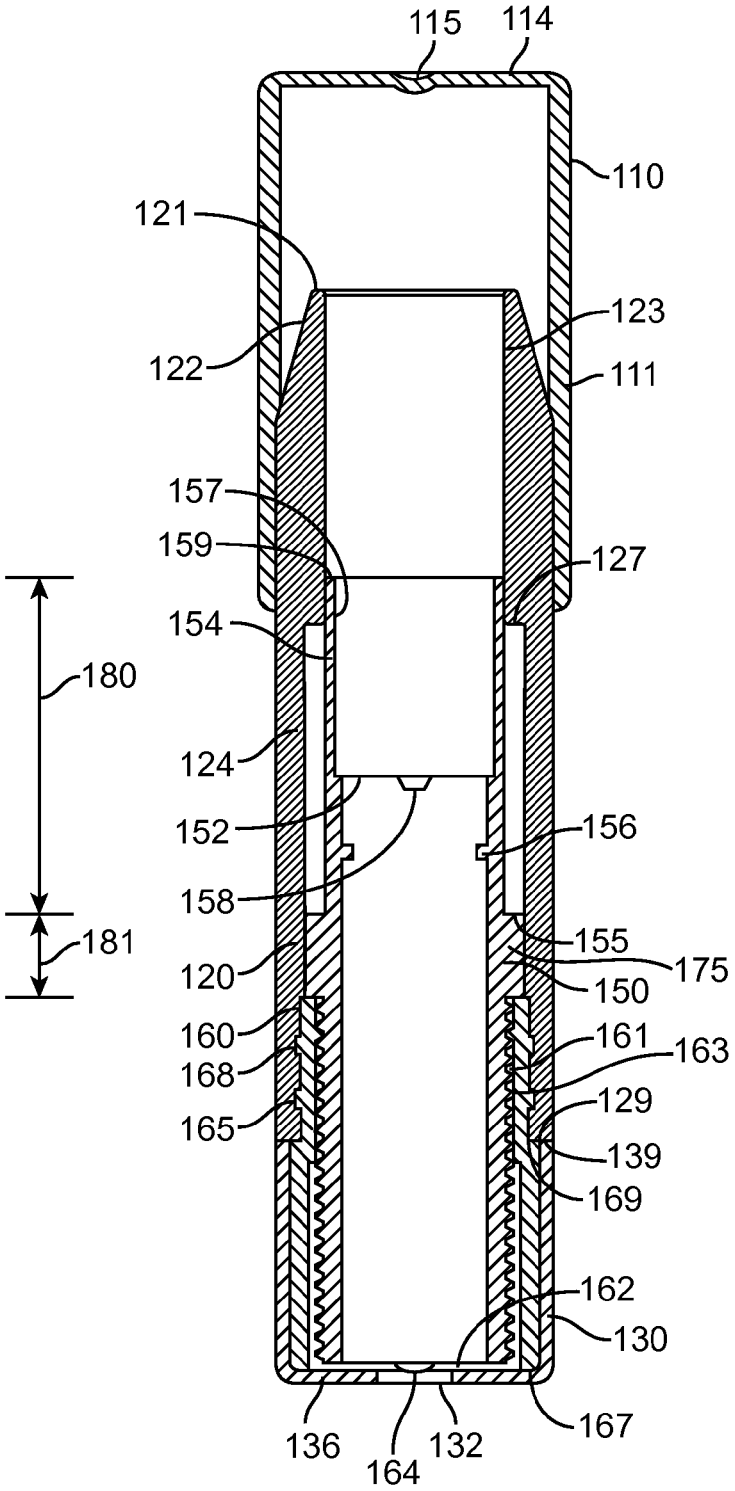
FIG. 8 illustrates a detailed cross-sectional view a retractable cosmetic pencil in a retracted configuration.

FIG. 8 illustrates a detailed cross-sectional view a retractable cosmetic pencil 100 in a retracted configuration. As illustrated, the godet 150 is retracted from its extended state as illustrated above with respect to FIG. 4. In the retracted state, the threads of the godet are moved so that the godet 150 moves to the retracted state where by the proximal end 162 of the godet is moved closer to the substantially closed end 136 of the end cap 130. As indicated above, the closed end 136 has an injection receiving opening 132 formed therein. The distal end 159 of the godet 150 remains within the inner side wall 123 of the barrel 120. As indicated above, this allows for the cosmetic to be moved within the barrel 120 without galling or otherwise causing malfunction of the retraction/extension mechanism which in the present disclosure is in the form of a lower threaded portion 160, barrel 120, a godet 150, and an end cap 130.

Figure 9:
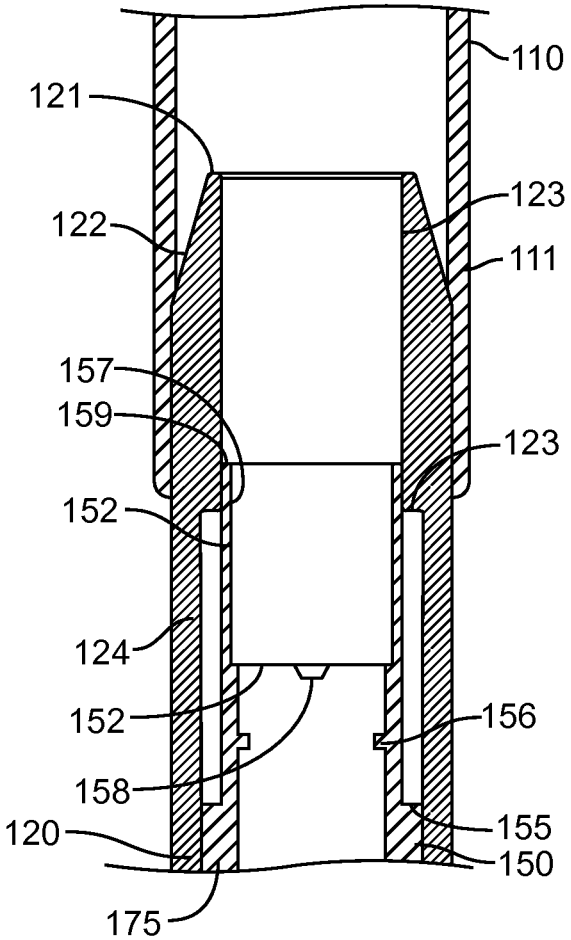
FIG. 9 illustrates a detailed cross-sectional view of barrel having a godet in a retracted state such that the end of the godet and is within an inner wall of the barrel.

FIG. 9 illustrates a detailed cross-sectional view of barrel 120 having a godet 150 in a retracted state such that the distal end 159 of the godet 150 and is within an inner wall 123 of the barrel 120. As described above, this enables the barrel 120 to be used as part of the mold when the cosmetic is injected through the injection opening 132 formed in the closed end 136 of end cap 130.

Figure 10:
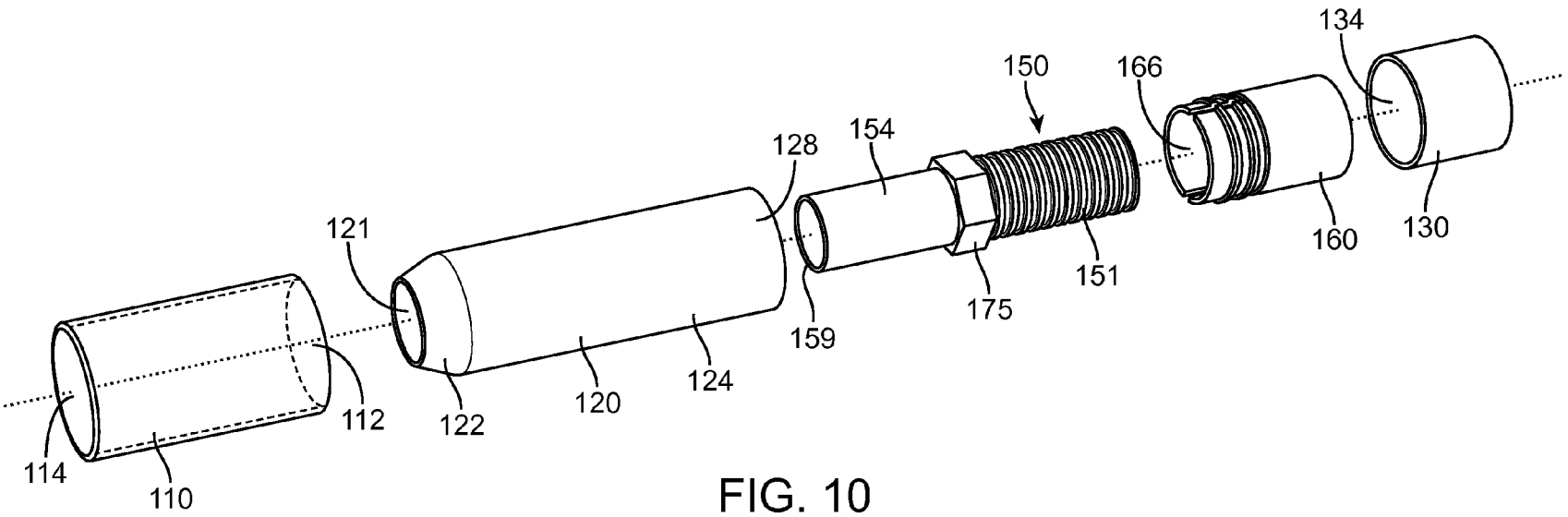
FIG. 10 illustrates an exploded perspective view of an exemplary retractable pencil according to the present disclosure.

FIG. 10 illustrates an exploded perspective view of an exemplary retractable cosmetic pencil 100 according to the present disclosure. As illustrated, the retractable cosmetic pencil can include a cosmetic cap 110 having a closed end 114 and a hole 112 formed in the opposite end. The hole 112 can be configured to receive the barrel 120. The barrel 120 can have a distal end 121 and godet receiving end 128. The distal end 121 can have a top portion 122 that can have a different shape than the side portion 124 of the barrel 120. The godet 150 can have a distal end 159 and a side wall 154. Additionally, a stop portion 175 can be formed on the godet 150. The stop portion 175 can also include a particular shape such as the hexagonal shape illustrated. When the stop portion 175 has a particular shape it can further prevent the godet 150 from rotating relative to the barrel 150. In order to provide the anti-rotation feature, at least a portion of an inner wall of the barrel 120 can have a corresponding shape. In the example provided, this shape can extend up until the stop forming portion 127 of the barrel 120 such that the smooth inner wall 123 can remain smooth for easy movement of the cosmetic therein. Additionally, a lower threaded portion 160 is illustrated. The lower threaded portion 160 can have an opening 166 formed in a distal end to receive the godet 150. The lower threaded portion 160 can include threads to receive the ridges 151 of the godet 150. Additionally, the lower threaded portion 160 can include slots formed therein to provide for flexibility as described above. The end cap 130 can include a lower threaded member 160 receiving opening formed therein.

FIG. 11 illustrates a cross-sectional view of an exemplary retractable cosmetic pencil 100 above a mold sheet 190 in a filling process, according to the present disclosure. In this view, the cosmetic formula 201 (illustrated in the form of an arrow 202) in a "wet" or non-set state is injected through the injection receiving opening 132 in the end cap 130. The cosmetic formula 201 can be injected using an injection device. The injection device can be sized based on one or more of the overall diameter of the desired cosmetic. The formula 201 is applied via an injection process which allows for the cosmetic to harden to a balm or solid form depending on the formula 201.

Additionally, the mold sheet 190 can include a cosmetic end shape mold portion 192. The cosmetic end shape mold 192 can be shaped on the final cosmetic product. As the formula 201 is injected in the retractable cosmetic pencil it exits through the barrel 120 into the mold sheet 190 and specifically the cosmetic end shape portion 192 of the mold sheet 190. Thereby, the desired shape is formed in the end of the cosmetic. The filling process can continue until the proximal end 204 of the cosmetic formula 201 reaches a desired level.

As illustrated the godet 150 is in a fully retracted state. In other descriptions, the retracted state can be described as a wound down state of the godet 150. In this configuration, the godet 150 can be in the position it will be in for shipment purposes. When the retractable cosmetic pencil 100 is in the retracted state when it is filled, the retractable cosmetic pencil can be shipped without performing any additional steps other than applying the desired labeling and cosmetic cap 110 or other similar features. Thus, the mechanism that provides for the retraction and extension can remain fixed without movement after the injection process is complete. Additionally, due to the edges of the godet 150, it can be moved back to this position without binding based on the formula 201. The smooth inner surface 123 of the barrel 120 can act as the mold for the pomade/formula surface. This can allow for a larger diameter fill as the fill diameter can based on the inner diameter of the barrel, rather than the smaller inner diameter of the godet 150. As illustrated in the retracted state, a gap 170 is formed between the stop 175 and stop forming portion 127 of the barrel 120. In this gap 170 the inner wall of the barrel 120 can have a shape so that the stop also functions as an anti-rotation device.

FIG. 12 illustrates an elevational view of another exemplary retractable cosmetic pencil 100 wherein the cosmetic has been extended to be in a fully extended state and a portion of the godet 150 is exposed. As illustrated, the distal end 159 of the godet 150 extends beyond the end of the barrel 120. In one embodiment, the filling of the retractable cosmetic pencil can be with the godet 150 in the extended position such that the distal end 159 of the godet 150 extends beyond the end of the barrel 120 and can be inserted into a mold. This allows the alignment of the retractable cosmetic pencil to be more easily obtained. Even in the extended configuration, the retractable cosmetic pencil 100 can be backfilled.

While the present disclosure has been described in relation to a retractable cosmetic pencil that can be back filled, the present disclosure can work with a variety of different filling techniques and types of cosmetics. The present disclosure can work with both solid and gel like cosmetics. Additionally, the cosmetic product can be premolded and inserted, hot poured, and back filled.

Additionally, while the present illustration of the embodiments of the retractable cosmetic pencil is substantially cylindrical, other embodiments are considered within the scope of this disclosure.

What is claimed is:

1. A retractable cosmetic pencil comprising:
a barrel;
a godet configured to move longitudinally within the barrel;
a lower threaded portion configured to be coupled to the godet by threads located on the inside of the lower threaded portion and the outside of the godet;
an end cap configured to be coupled to the lower threaded portion and having a closed end;
an injection receiving opening formed in a closed end of the end cap, wherein the injection receiving opening is configured to receive an injection nozzle such that the retractable cosmetic pencil can be backfilled when the godet is in a retracted position relative to the lower threaded portion;
wherein the end cap is fixed in an axial direction relative to the barrel and the godet has a plurality of protrusions that extend in a radially inward direction and are configured to support a cosmetic.

2. The retractable cosmetic pencil of claim 1, wherein the godet has a first diameter and a second diameter and a cosmetic retention member is located within the first diameter that is larger than the second diameter.

3. The retractable cosmetic pencil of claim 1, wherein the godet has a stop portion formed thereon that is configured to contact a portion of the of the barrel.

4. The retractable cosmetic pencil of claim 1, wherein the godet, when the godet is fully extended, is configured to be substantially flush at an open end of the barrel.

5. A retractable cosmetic pencil comprising:
a barrel;
a godet configured to move longitudinally within the barrel;
a lower threaded portion configured to be coupled to the godet by threads located on the inside of the lower threaded portion and the outside of the godet;
an end cap configured to be coupled to the lower threaded portion and having a closed end;
an injection receiving opening formed in a closed end of the end cap, wherein the injection receiving opening is configured to receive an injection nozzle such that the retractable cosmetic pencil can be backfilled when the godet is in a retracted position relative to the lower threaded portion;
wherein the end cap is fixed in an axial direction relative to the barrel and the godet, when the godet is fully extended, is configured to be substantially flush at an open end of the barrel.

6. The retractable cosmetic pencil of claim 5, wherein the godet has a first diameter and a second diameter and a cosmetic retention member is located within the first diameter that is larger than the second diameter.

7. The retractable cosmetic pencil of claim 5, wherein the godet has a stop portion formed thereon that is configured to contact a portion of the of the barrel.

8. The retractable cosmetic pencil of claim 5, wherein the godet has a plurality of protrusions that extend in a radially inward direction and are configured to support a cosmetic.

9. A retractable cosmetic pencil comprising:
a barrel;
a godet configured to move longitudinally within the barrel;
a lower threaded portion configured to be coupled to the godet by threads located on the inside of the lower threaded portion and the outside of the godet;
an end cap configured to be coupled to the lower threaded portion and having a closed end;
an injection receiving opening formed in a closed end of the end cap, wherein the injection receiving opening is configured to receive an injection nozzle such that the retractable cosmetic pencil can be backfilled when the godet is in a retracted position relative to the lower threaded portion;
wherein the end cap is fixed in an axial direction relative to the barrel and the godet has a first diameter and a second diameter and a cosmetic retention member is located within the first diameter that is larger than the second diameter.

10. The retractable cosmetic pencil of claim 9, wherein the godet has a stop portion formed thereon that is configured to contact a portion of the of the barrel.

11. The retractable cosmetic pencil of claim 9, wherein the godet has a plurality of protrusions that extend in a radially inward direction and are configured to support a cosmetic.

12. The retractable cosmetic pencil of claim 9, wherein the godet, when the godet is fully extended, is configured to be substantially flush at an open end of the barrel.

* * * * *